US009897000B2

(12) United States Patent
Durrett et al.

(10) Patent No.: US 9,897,000 B2
(45) **Date of Patent: *Feb. 20, 2018**

(54) EXHAUST COMPOUND INTERNAL COMBUSTION ENGINE WITH CONTROLLED EXPANSION

(71) Applicant: GM GLOBAL TECHNOLOGY OPERATIONS LLC, Detroit, MI (US)

(72) Inventors: Russell P. Durrett, Bloomfield Hills, MI (US); Paul M. Najt, Bloomfield Hills, MI (US); Peter P. Andruskiewicz, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 372 days.

This patent is subject to a terminal disclaimer.

(21) Appl. No.: 14/736,030

(22) Filed: Jun. 10, 2015

(65) Prior Publication Data

US 2015/0275747 A1 Oct. 1, 2015

Related U.S. Application Data

(63) Continuation-in-part of application No. 14/050,089, filed on Oct. 9, 2013, now Pat. No. 9,080,508.

(60) Provisional application No. 61/721,958, filed on Nov. 2, 2012.

(51) Int. Cl.

| | |
|---|---|
| ***F02B 33/22*** | (2006.01) |
| ***F02B 75/04*** | (2006.01) |
| ***F02B 41/08*** | (2006.01) |

(52) U.S. Cl.

CPC ..... *F02B 75/04* (2013.01); *F02B 41/08* (2013.01)

(58) Field of Classification Search

CPC ..... F02B 75/04; F02B 41/08
USPC ..... 123/70 R, 198 F, 69 R, 69 V, 72, 58.8
See application file for complete search history.

(56) References Cited

U.S. PATENT DOCUMENTS 1,601,548 A * 9/1926 Zier ..... F02B 1/00 123/58.1
2,216,801 A * 10/1940 Baster ..... F01N 13/10 123/41.28
3,109,416 A * 11/1963 Hurst ..... F02B 75/20 123/184.41

(Continued)

FOREIGN PATENT DOCUMENTS

CN 201714483 U 1/2011

*Primary Examiner* — Marguerite McMahon
(74) *Attorney, Agent, or Firm* — John A. Miller; Miller IP Group, PLC

(57) ABSTRACT

A piston compound internal combustion engine is disclosed with an expander piston deactivation feature. A piston internal combustion engine is compounded with a secondary expander piston, where the expander piston extracts energy from the exhaust gases being expelled from the primary power pistons. The secondary expander piston can be deactivated and immobilized, or its stroke can be reduced, under low load conditions in order to reduce parasitic losses and over-expansion. Two mechanizations are disclosed for the secondary expander piston's coupling with the power pistons and crankshaft. Control strategies for activation and deactivation of the secondary expander piston are also disclosed. In addition, six-cylinder engine configurations are defined by replicating groups of two power pistons and one expander piston.

20 Claims, 6 Drawing Sheets

(56) References Cited

U.S. PATENT DOCUMENTS

| | | | | |
|---|---|---|---|---|
| 3,168,081 | A * | 2/1965 | Bauer | F02F 1/108<br>123/195 R |
| 4,202,300 | A * | 5/1980 | Skay | F02B 33/22<br>123/432 |
| 6,553,977 | B2 * | 4/2003 | Schmitz | F02B 41/06<br>123/561 |
| 9,080,508 | B2 * | 7/2015 | Durrett | F02B 41/08 |
| 2010/0242582 | A1 * | 9/2010 | Wang | F02D 41/0082<br>73/114.62 |
| 2010/0300385 | A1 | 12/2010 | Durrett et al. | |
| 2011/0094462 | A1 | 4/2011 | Durrett et al. | |
| 2012/0204561 | A1 * | 8/2012 | Schlosser | F02B 67/00<br>60/612 |
| 2013/0037005 | A1 * | 2/2013 | Graf | F02D 9/04<br>123/481 |

* cited by examiner

EXHAUST COMPOUND INTERNAL COMBUSTION ENGINE WITH CONTROLLED EXPANSION

CROSS-REFERENCE TO RELATED APPLICATIONS

This application is a continuation-in-part application of U.S. patent application Ser. No. 14/050,089, titled PISTON COMPOUND INTERNAL COMBUSTION ENGINE WITH EXPANDER DEACTIVATION, filed Oct. 9, 2013, which claimed the benefit of the priority date of U.S. Provisional Patent Application Ser. No. 61/721,958, titled PISTON COMPOUND INTERNAL COMBUSTION ENGINE WITH EXPANDER DEACTIVATION, filed Nov. 2, 2012.

BACKGROUND OF THE INVENTION

Field of the Invention

This invention relates generally to a compound internal combustion piston engine and, more particularly, to a compound internal combustion piston engine with a secondary expander piston for improved efficiency at medium and high loads, where the secondary expander piston can be deactivated and made stationary under low load conditions in order to reduce parasitic losses and over-expansion, and where groups of two power pistons and one expander piston are replicated to define various six-cylinder configurations.

Discussion of the Related Art

Internal combustion engines are a proven, effective source of power for many applications, both stationary and mobile. Of the different types of internal combustion engines, the piston engine is by far the most common in automobiles and other land-based forms of transportation. While engine manufacturers have made great strides in improving the fuel efficiency of piston engines, further improvements must be made in order to conserve limited supplies of fossil fuels, reduce environmental pollution, and reduce operating costs for vehicle owners.

One technique for improving the efficiency of piston engines is to employ a secondary expander piston to extract additional energy from exhaust gases before the exhaust gases are expelled to the environment. Secondary expander pistons can be effective at improving efficiency under relatively high loads, where exhaust gases still have a considerable amount of energy. However, secondary expander pistons are not very effective, and in fact can be counterproductive, under low load conditions, where parasitic losses can outweigh the benefit of any additional extracted energy. Because automobile engines inherently operate under widely varying conditions, including a substantial amount of low-load operation, traditional secondary expander piston engine designs have not proven beneficial.

SUMMARY OF THE INVENTION

In accordance with the teachings of the present invention, a piston compound internal combustion engine is disclosed with an expander piston deactivation feature. A piston internal combustion engine is compounded with a secondary expander piston, where the expander piston extracts energy from the exhaust gases being expelled from the primary power pistons. The secondary expander piston can be deactivated and immobilized, or its stroke can be reduced, under low load conditions in order to reduce parasitic losses and over-expansion. Two mechanizations are disclosed for the secondary expander piston's coupling with the power pistons and crankshaft. Control strategies for activation and deactivation of the secondary expander piston are also disclosed. In addition, six-cylinder engine configurations are defined by replicating groups of two power pistons and one expander piston.

Additional features of the present invention will become apparent from the following description and appended claims, taken in conjunction with the accompanying drawings.

DETAILED DESCRIPTION OF THE EMBODIMENTS

The following discussion of the embodiments of the invention directed to an exhaust compound internal combustion engine with controlled expansion is merely exemplary in nature, and is in no way intended to limit the invention or its applications or uses.

Obtaining the maximum fuel efficiency from internal combustion engines has long been an objective of engine designers. One technique which has been employed in the past is to incorporate a secondary expander piston into an engine, where the expander piston extracts additional energy from the engine's exhaust gases.

Figure 1:
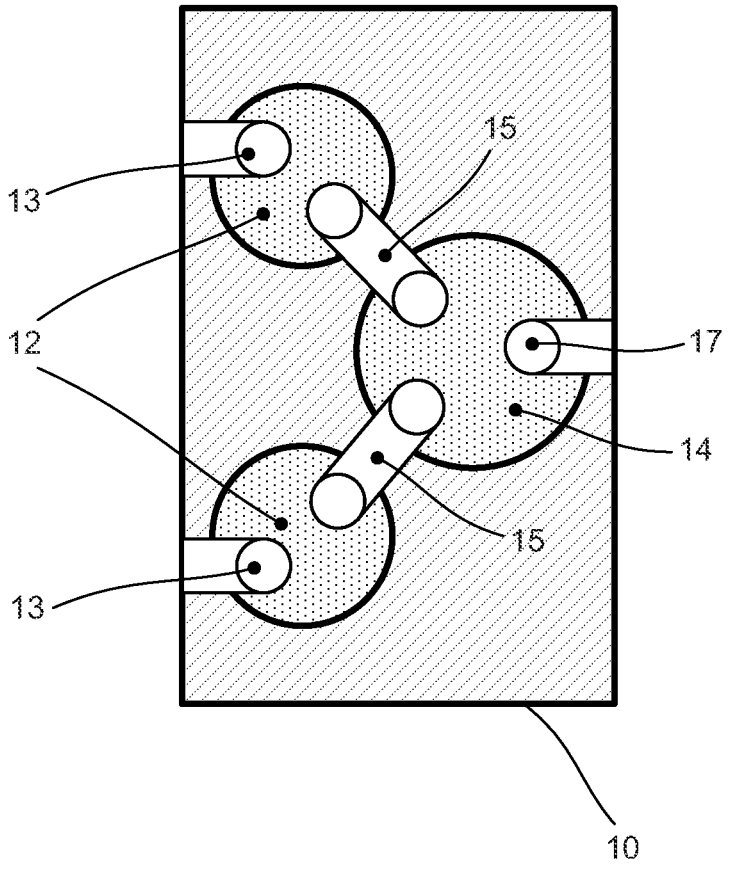
FIG. 1 is a top view illustration of a piston engine which is compounded with a secondary expander piston.

FIG. 1 is a top view illustration of a piston engine which is compounded with a secondary expander piston. The engine 10 includes two power pistons 12, which are the pistons normally found in an internal combustion engine. The power pistons 12, in their respective cylinders, receive a charge of fuel and air through an inlet port 13, which is then compressed, ignited, and expanded. After the combustion gases are expanded on the power stroke, the gases are exhausted from the power pistons' cylinders. In the compound engine 10, instead of exhausting the gases from the power pistons 12 through an exhaust system to the environment, the exhaust gases are routed through a transfer port 15 to a secondary expander piston 14, which extracts additional energy from the exhaust gases on its power stroke, then exhausts the gases to the environment through an exhaust port 17. Because the gases have already been expanded once by the power pistons 12, gas pressures are lower on the expander piston 14. Therefore, the expander piston 14 has a considerably larger bore than the power pistons 12.

A ratio of two of the power pistons 12 to one of the expander pistons 14 is ideal in a 4-stroke-per-cycle engine. This is because the two power pistons 12, which are mechanically in phase (both at Top Dead Center (TDC) at the same time, etc.), are 360 degrees out of phase relative to their combustion cycles (one of the power pistons 12 is beginning an intake stroke when the other is beginning a power stroke, etc.). Therefore, each time the expander piston 14 reaches TDC, one of the power pistons 12 has reached Bottom Dead Center (BDC) on its power stroke and is ready to discharge its gases to the expander piston 14 through its respective transfer port 15. Thus, the expander piston 14 operates in a 2-stroke mode, with a power stroke and an exhaust stroke on each crankshaft revolution.

The engine 10 could operate on diesel fuel (compression ignition), or it could operate on gasoline or a variety of other fuels (spark ignition). The engine 10 could include only the two power pistons 12 and the one expander piston 14, or the engine 10 could be scaled up to four or eight of the power pistons 12, with one expander piston 14 for every two power pistons 12. In automotive applications, the engine 10 could directly power the vehicle via a transmission and driveline, or the engine 10 could serve as an auxiliary power unit to provide electrical energy via a generator. The engine 10 could also be used in a wide variety of non-automotive applications, including primary or backup electrical generation, pumping, etc.

Although secondary expander piston engine designs have been known for some time, the concept has not proven viable for most engine applications, largely because the parasitic losses associated with the secondary expander piston 14 outweigh the additional energy extracted under low load conditions. Specifically, in situations where there is little energy remaining in the exhaust gases after the primary expansion by the power pistons 12, the energy extracted from a secondary expansion of the exhaust gases is not enough to overcome the friction of the expander piston 14 in its cylinder. Because engines in automobiles—and most other applications—frequently operate at low load, little or no overall fuel efficiency improvement has been realized by secondary expander piston engines. However, if the expander piston 14 could be deactivated and made stationary at low loads, the parasitic losses associated with the expander piston 14 would be eliminated, and the engine's overall fuel efficiency would be significantly increased.

Figure 2:
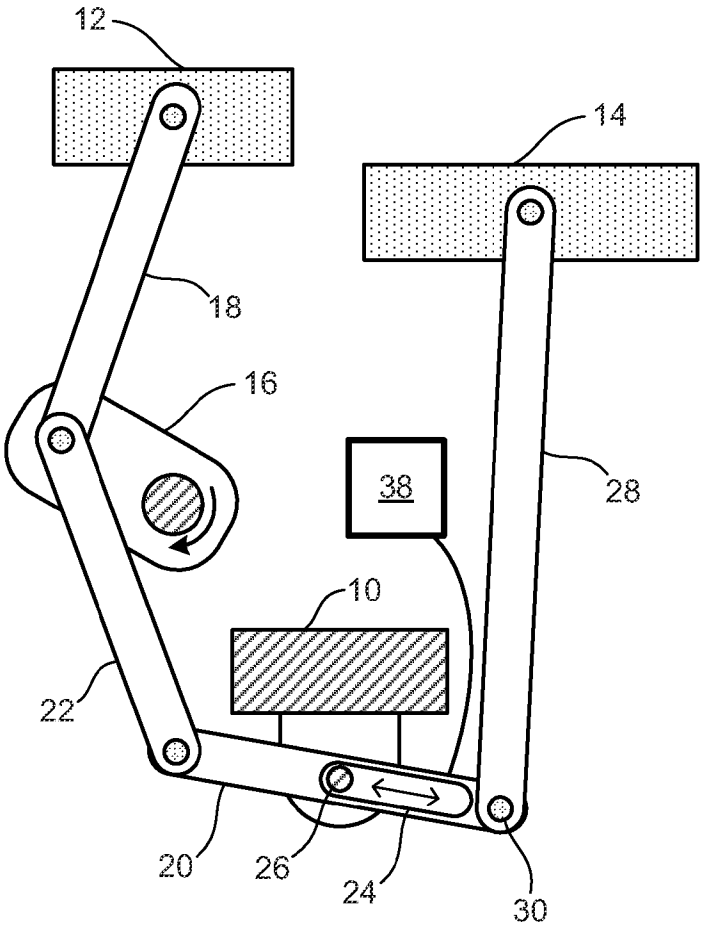
FIG. 2 is a side view illustration of a first mechanization for coupling the secondary expander piston to the engine's power pistons and crankshaft, while allowing deactivation or reduced stroke of the expander piston.

FIG. 2 is a side view illustration of a first mechanization for coupling the secondary expander piston 14 to the engine's power pistons 12 and crankshaft, while allowing deactivation or reduced stroke of the expander piston 14. The power pistons 12 (one shown) are coupled to a crankshaft 16 via a connecting rod 18, in an arrangement typical of any piston engine. The crankshaft 16 is then coupled to a stroke adjustment link 20 via a connecting link 22. The stroke adjustment link 20 includes a slot 24 which allows the position of the stroke adjustment link 20 to be adjusted relative to a pivot pin 26. The pivot pin 26 is a "ground" point—that is, it is attached to the block of the engine 10. A connecting rod 28 is connected at one end to the expander piston 14, and at the other end to the stroke adjustment link 20 at a pivot point 30.

By adjusting the position of the stroke adjustment link 20 relative to the pivot pin 26, the stroke of the expander piston 14 can be increased or decreased. As shown in FIG. 2, with the pivot pin 26 approximately centered along the length of the stroke adjustment link 20, the expander piston 14 will have approximately the same stroke as the power piston 12. However, if the stroke adjustment link 20 is positioned such that the pivot pin 26 is at the far (right) end of the slot 24, then the expander piston 14 will have a very short stroke. In practice, a design can be realized which allows the pivot point 30 to be positioned along the axis of the pivot pin 26, thus resulting in no motion of the expander piston 14. Under low load engine conditions, it may be desirable to completely deactivate and immobilize the expander piston 14. However, as will be discussed below, under certain conditions it may be desirable to reduce the stroke of the expander piston 14, but not completely immobilize it.

Figure 3:
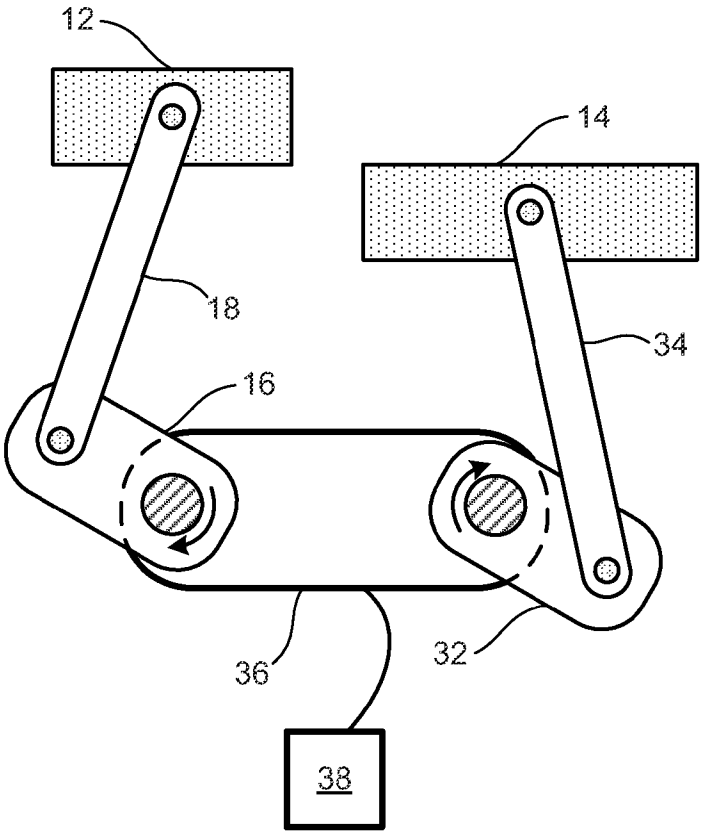
FIG. 3 is a side view illustration of a second mechanization for coupling the secondary expander piston to the engine's power pistons and crankshaft, while allowing deactivation of the expander piston.

FIG. 3 is a side view illustration of a second mechanization for coupling the secondary expander piston 14 to the engine's power pistons 12 and crankshaft 16, while allowing deactivation of the expander piston 14. In this embodiment, the secondary expander piston 14 is coupled to a secondary crankshaft 32 via a connecting rod 34. The rotation of the secondary crankshaft 32 is coupled to the rotation of the crankshaft 16 via a clutch 36. The clutch 36 must be a dog clutch or other such design that provides a positive mechanical engagement between the secondary crankshaft 32 and the crankshaft 16—such that the rotational speeds of the two shafts are the same, and the required relative position is maintained. In this embodiment, the expander piston 14 can easily be deactivated and immobilized by disengaging the clutch 36. A reduced stroke mode of operation is not inherently enabled in this embodiment, although a reduced stroke feature could be added to the secondary crankshaft 32.

In both of the embodiments discussed above, which may collectively be referred to as de-stroking mechanisms, a controller 38 monitors engine conditions and establishes the desired stroke, or activation/deactivation, of the expander piston 14. The controller 38 then actuates the link 20 or the clutch 36 to control the actual stroke of the expander piston 14 based on the desired stroke.

The controller 38 is a device typical of any electronic control unit (ECU) in an automobile, including at least a microprocessor and a memory module. The microprocessor is configured with a particularly programmed algorithm based on the logic described herein, using data from sensors—such as exhaust gas temperature sensors, an engine torque sensor, a throttle position sensor, etc.—as input.

In both design embodiments, the proper geometric relationship between the power pistons 12 and the expander piston 14 is maintained. That is, when the power piston 12 is at TDC, the expander piston 14 is at BDC, and vice versa. This relationship is inherently maintained by the linkage of the first embodiment (FIG. 2), and maintained by way of the design of the clutch 36 in the second embodiment (FIG. 3).

In FIG. 3, it is even conceivable to allow the expander piston 14 and the secondary crankshaft 32 to operate independent of any mechanical coupling to the crankshaft 16. For example, in an electrical power generation application, the secondary crankshaft 32 could drive a small secondary generator. The valving of the exhaust gases from the power pistons 12 to the expander piston 14 would inherently tend to drive the secondary crankshaft 32 at the same speed as, and at the correct phase relationship to, the crankshaft 16.

A variety of control strategies can be envisioned which take advantage of the piston compound internal combustion engine with expander deactivation or stroke adjustment. As discussed above, it is known that expander deactivation is desirable at low load conditions. Other factors also come into consideration. For example, exhaust gas after-treatment devices, such as catalytic converters, are only effective when they reach a certain minimum temperature. In a real world automotive application, it would not be desirable to extract so much energy from the exhaust gases that the exhaust after-treatment system drops below its minimum effective temperature. This criterion can be incorporated into a control strategy. Also, in practice, it may be desirable to add a hysteresis effect to the control of the expander piston 14, such that it is not repeatedly activated and deactivated at high frequency.

Figure 4:
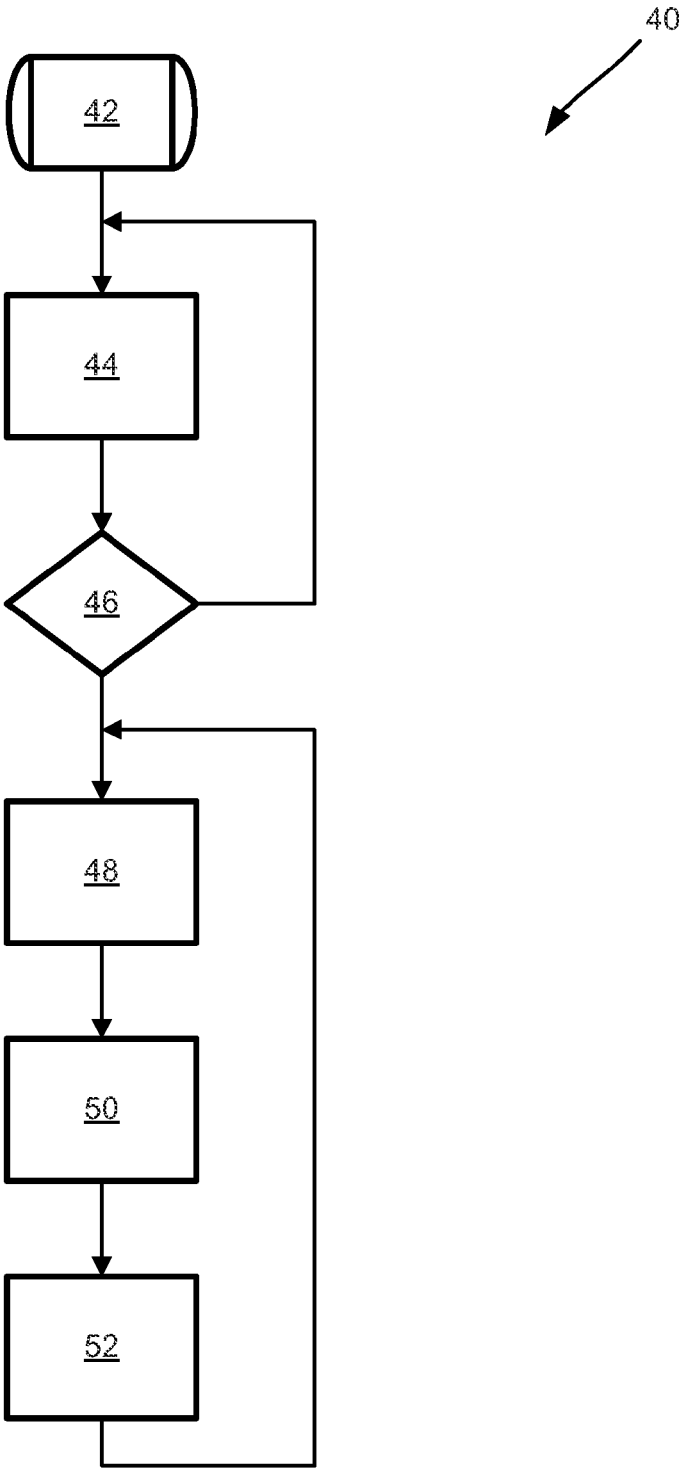
FIG. 4 is a flowchart diagram of a first method for activating and deactivating the secondary expander piston in order to optimize engine efficiency.

FIG. 4 is a flowchart diagram 40 of a method for activating and deactivating the secondary expander piston 14 in order to optimize engine performance and efficiency. The controller 38 would be configured to follow the method steps of the flowchart diagram 40. At start box 42, the engine 10 is started. When the engine 10 is started, the expander piston 14 is deactivated and immobilized. At box 44, exhaust system temperature is measured. At decision diamond 46, the exhaust system temperature is compared to a first threshold temperature. If the exhaust system temperature is below the first threshold, which is the minimum effective temperature of the exhaust after-treatment devices, then the expander piston remains deactivated and immobilized, and the process loops back to again measure the exhaust system temperature at the box 44 after some time delay.

If the exhaust system temperature is above the first threshold temperature at the decision diamond 46, then engine output torque is measured at box 48. Engine output torque is considered to be a good indicator of whether engine load is high enough to warrant the engagement of the secondary expander piston 14. It is certainly conceivable to use other measurements, individually or in combination, as an indication of engine load level. Such other measurements could include fuel flow rate, cylinder head temperature (for the power piston 12), cylinder pressure (for the power piston 12), etc. In any case, some reliable indication of engine load is needed, and is obtained at the box 48, for control of the expander piston 14.

At box 50, exhaust system temperature is again measured. At box 52, a control algorithm is used to determine the desired stroke of the expander piston 14, and the process loops back to again measure engine output torque. The control algorithm can be adapted to handle variable stroke engine designs, where the stroke of the expander piston 14 may be normalized to vary from zero (immobilized) to one (full or maximum stroke possible for the engine mechanization). The algorithm can also be adapted to allow only full activation and deactivation of the expander piston 14, but not variable stroke.

The control algorithm may advantageously use a strategy which considers both engine load (torque) and exhaust system temperature, while including a hysteresis effect to avoid rapid repeated activation and deactivation of the expander piston 14. For example, if engine torque is below a first torque threshold or exhaust system temperature is below the first temperature threshold, the expander piston 14 would be deactivated. If engine torque is above a second torque threshold and exhaust system temperature is above a second temperature threshold, the expander piston 14 would be activated at full stroke. If the engine 10 supports variable stroke of the expander piston 14, then the stroke can be adjusted between the values of zero and one as a function of the engine torque and the exhaust system temperature relative to their respective thresholds. If the engine 10 supports only full activation and deactivation of the expander piston 14, only one temperature threshold and one torque threshold may be used, where the expander piston 14 is activated when both thresholds are exceeded. Hysteresis can be added, for example by requiring several consecutive measurement cycles at a certain condition before changing the stroke of the expander piston 14.

By adding a deactivation feature or a variable stroke feature to a piston compound internal combustion engine as described above, the fuel efficiency improvement of a secondary expander piston can be realized when an engine is operating at medium or high load, but the parasitic losses of the expander piston can be eliminated when the engine is operating at low load. This selective expander piston de-stroking offers another approach to increasing fuel efficiency, which is so important to both automakers and consumers.

As mentioned briefly above, it is possible to scale up the engine 10 to include more than just the three cylinders (two power pistons and one expander piston) shown in FIG. 1.

Figure 5:
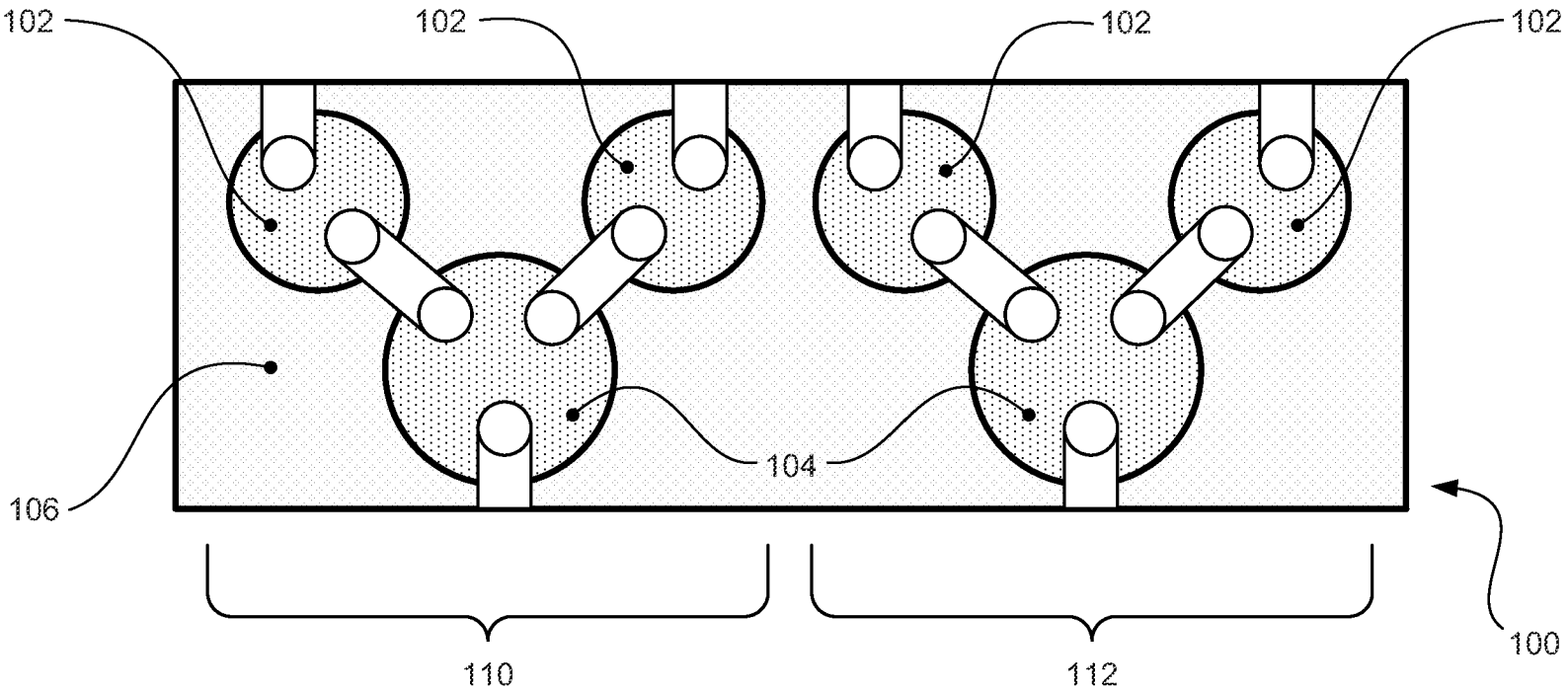
FIG. 5 is a top view illustration of a piston engine which is compounded with secondary expander pistons, in a straight six cylinder configuration.

FIG. 5 is a top view illustration of a piston engine 100 which is compounded with secondary expander pistons, in a "straight six" cylinder configuration. The engine 100 shows how the concept of exhaust compounding with expander de-stroking or deactivation can be scaled up to a larger engine size capable of powering a full-size car or truck.

The engine 100 includes power pistons 102 and secondary expander pistons 104 in a cylinder block 106, where the power pistons 102 and the expander pistons 104 are arranged in groups of three. That is, a first group 110 is comprised of two of the power pistons 102 and one of the expander pistons 104. Likewise for a second group 112. The advantage of grouping two of the power pistons 102 with one of the expander pistons 104 was explained in detail previously, where the two power pistons 102 operate in a 4 stroke/cycle mode and are 360 out of phase with each other, and the expander piston 104 operates in a 2 stroke/cycle mode and receives exhaust gas from one of the power pistons 102 on every stroke at TDC.

Although the centerlines of all six cylinders in the engine 100 are not in a single plane, the engine 100 generally resembles a "straight six" engine in that all six cylinders are contained in a single block or bank of cylinders, and all six cylinders have the same orientation (for example, pistons at the top and crankshaft at the bottom).

In the preferred design of the straight six cylinder engine 100, all four of the power pistons 102 share the same crankshaft. The phasing of the four power pistons 102 could be handled in at least two different manners. The simplest approach is to have all four of the power pistons 102 in phase (such as all at TDC at the same time), with each of the power pistons 102 feeding exhaust gas to the nearest of the expander pistons 104 as shown in FIG. 5. Another approach would be akin to a typical four cylinder engine where, in order to optimize mechanical balance, the inboard two pistons are in phase (such as at BDC) while the outboard two pistons are in phase (such as at TDC). This piston/crankshaft arrangement would require a different exhaust porting configuration, where the inboard two pistons would feed one of the expander pistons 104 while the outboard two pistons would feed the other of the expander pistons 104.

The engine 100 can be designed to employ either of the expander piston de-stroking/deactivation mechanisms shown in FIGS. 2 and 3 and discussed previously. Using the variable stroke slider mechanism of FIG. 2, both of the expander pistons 104 would be set to the same stroke. Using the dual crankshaft and clutch mechanism of FIG. 3, both of the expander pistons 104 would share the same secondary crankshaft, and both would be either engaged or disengaged based on the status of the clutch.

The engine 100 may advantageously be supercharged or turbocharged, thereby increasing the power density from the power pistons 102, and also making additional exhaust energy (temperature and pressure) available for secondary expansion under many circumstances. Other six cylinder engine arrangements employing exhaust compounding with expander de-stroking or deactivation can also be devised. Two of these are discussed below.

Figure 6:
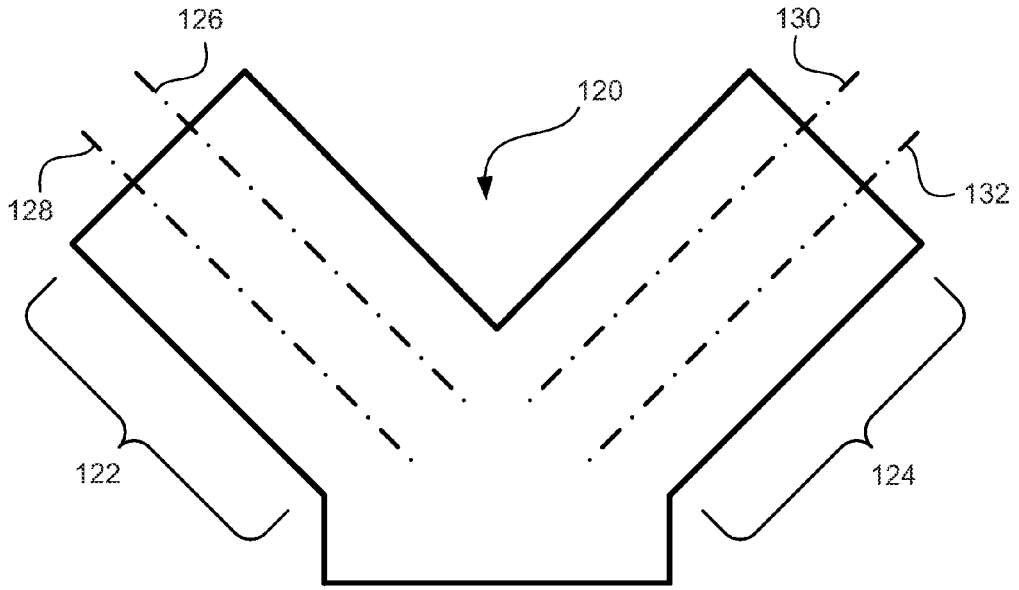
FIG. 6 is an end view illustration of a piston engine which is compounded with secondary expander pistons, in a V-six cylinder configuration.

FIG. 6 is an end view illustration of a piston engine 120 which is compounded with secondary expander pistons, with two banks of cylinders in a V-six cylinder configuration. The engine 120 includes two groups of three cylinders each, as discussed above for the engine 100, however the groups are configured differently. A first group 122 includes two power pistons operating in cylinders with a centerline 126, along with one expander piston operating in a cylinder with a centerline 128. Similarly, a second group 124 includes two power pistons operating in cylinders with a centerline 130, along with one expander piston operating in a cylinder with a centerline 132. It is readily apparent in FIG. 6 how the two power pistons operating along the centerline 126 and the two power pistons operating along the centerline 130 can share a crankshaft, as in any V-block engine configuration. Likewise, the expander piston operating along the centerline 128 and the expander piston operating along the centerline 132 can share a secondary crankshaft (in the FIG. 3 embodiment), or each cylinder bank could have its own secondary crankshaft, as determined to best optimize packaging and mass.

Figure 7:
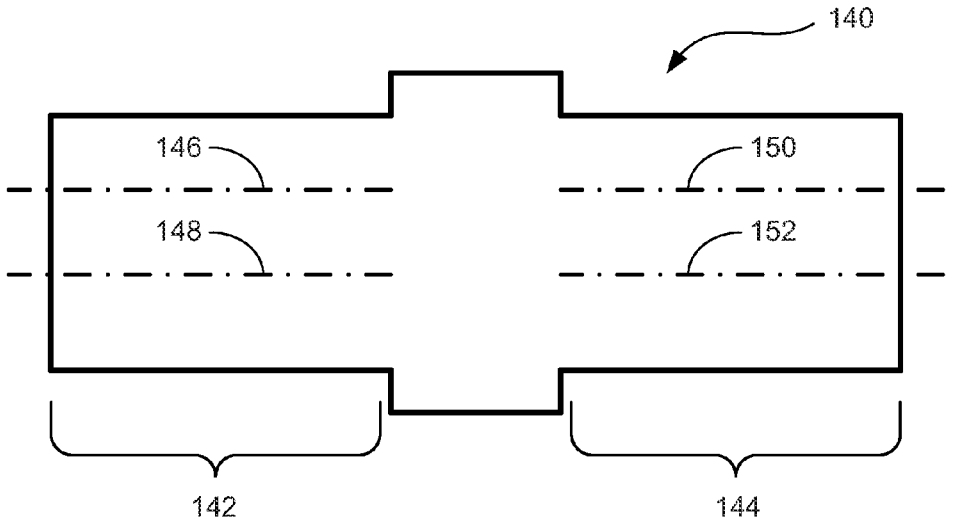
FIG. 7 is an end view illustration of a piston engine which is compounded with secondary expander pistons, in a horizontally opposed six cylinder configuration.

FIG. 7 is an end view illustration of a piston engine 140 which is compounded with secondary expander pistons, with two banks of cylinders in a horizontally opposed six cylinder configuration. The engine 140 includes two groups of three cylinders each, as discussed above for the engine 120, with the only difference being that the two cylinder banks are horizontally opposed rather than in a V-block configuration. A first group 142 includes two power pistons operating in cylinders with a centerline 146, along with one expander piston operating in a cylinder with a centerline 148. Similarly, a second group 144 includes two power pistons operating in cylinders with a centerline 150, along with one expander piston operating in a cylinder with a centerline 152. Crankshaft sharing in the horizontally opposed engine 140 can be handled in a manner analogous to the V-six engine 120 discussed above.

Figure 8:
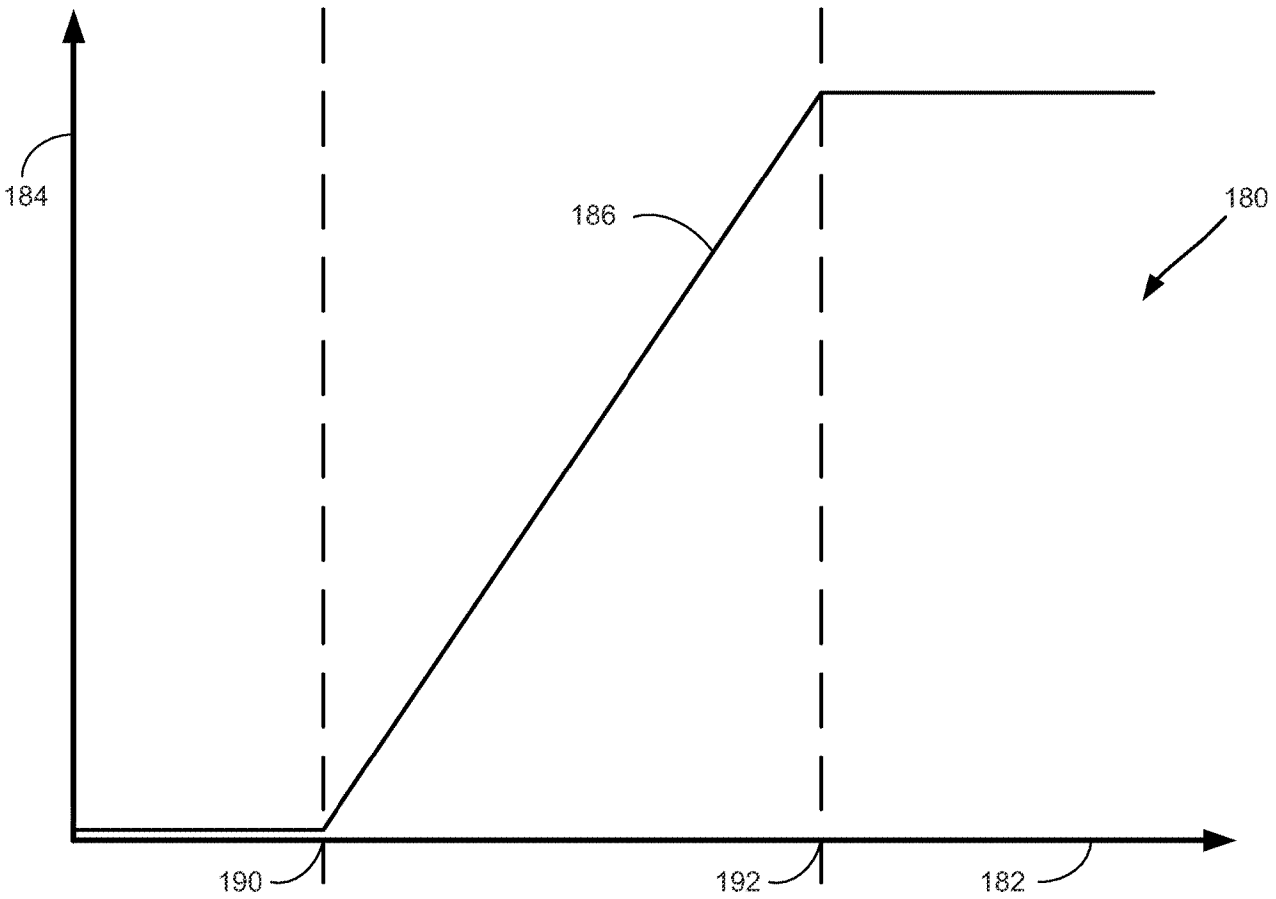
FIG. 8 is a graph showing how expander piston desired stroke can be controlled as a function of engine load or temperature.

FIG. 8 is a graph showing how expander piston desired stroke can be controlled as a function of engine load or exhaust gas temperature. Horizontal axis 182 represents engine load (which may be represented by torque, throttle position or other appropriate value, as discussed previously) or exhaust gas temperature. Vertical axis 184 represents expander piston desired stroke. Line 186 defines the desired expander piston stroke as a function of engine load or exhaust gas temperature, as described above in reference to the flowchart diagram 40 of FIG. 4.

A first threshold 190 represents a value (of engine load or exhaust gas temperature) below which the expander piston stroke should be set to zero, or to the minimum stroke value possible with the variable stroke mechanism of FIG. 2. A second threshold 192 represents a value above which the expander piston stroke should be set to full-stroke. In between the first threshold 190 and the second threshold 192, the expander piston stroke can be controlled according to the linear ramp function of the line 186. The line 186 could also have some shape other than a straight line ramp, such as a ¼ sine wave which provides a smooth transition at the thresholds 190 and 192.

As described above, engine load and exhaust gas temperature may be used as control parameters for expander piston stroke. This is because it is desirable to run the expander piston only when there is sufficient energy (pressure and temperature) in the exhaust gas. It is also desirable to ensure exhaust gas temperature (after the secondary expansion) is sufficiently high for exhaust after-treatment. A combination of engine load and exhaust gas temperature may be used in a two-step decision process. An example of a two-step decision process would be to first evaluate exhaust gas temperature and, if exhaust gas temperature is above a temperature threshold, continue to evaluate engine load and thereby establish expander piston stroke according to FIG. 8, and as described above in reference to the flowchart diagram 40 of FIG. 4.

The graph shown in FIG. 8 is applicable to the variable stroke mechanization shown in FIG. 2, where the stroke of the expander piston 14 can be continuously controlled from 0-100% of its maximum value, or from a minimum stroke value to a full-stroke value. A similar control strategy to that shown in FIG. 8 can also be applied to the clutch-based mechanization shown in FIG. 3, where the stroke of the expander piston 14 would be set to 0% (disengaged) if the control parameter (engine load or exhaust gas temperature, or combination) is below a threshold value, and the stroke would be set to 100% (engaged) if the control parameter is above the threshold value. The single threshold value in the case of the clutch-based mechanization would be in between the thresholds 190 and 192 shown on FIG. 8. A hysteresis effect may be added to the control of the expander piston 14, such that it is not rapidly activated and deactivated, as discussed previously.

Based upon the discussion above, it should be apparent to those skilled in the art of engine design that exhaust compounding with expander de-stroking or deactivation could be further scaled up to even larger engine sizes, such as a straight nine cylinder or a V-12 cylinder. These six cylinder and larger engines can deliver all of the efficiency advantages of variable stroke exhaust compounding, while also delivering enough power for larger vehicle applications.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A piston compound internal combustion engine with expander de-stroking, said engine comprising:

a rotating crankshaft;

two or more groups of three pistons, where each group includes two power pistons coupled to the rotating crankshaft, said power pistons providing engine power as a result of a primary expansion of combustion gases from ignition of a fuel-air mixture, and a secondary expander piston, said expander piston providing additional engine power as a result of a secondary expansion of the combustion gases after the primary expansion by the power pistons;

a de-stroking mechanism for reducing or eliminating a stroke of the expander pistons under certain engine conditions; and a controller configured to measure engine conditions, establish a desired stroke of the expander pistons based on the engine conditions, and communicate the desired stroke to the de-stroking mechanism.

2. The engine of claim 1 wherein the de-stroking mechanism allows the stroke of the expander pistons to be continuously adjustable from a minimum stroke value to a full stroke value.

3. The engine of claim 2 wherein the de-stroking mechanism is a variable stroke mechanism comprising a stroke adjustment link which adjustably couples the stroke of the expander pistons to a stroke of the power pistons.

4. The engine of claim 1 wherein the de-stroking mechanism allows the expander pistons to be fully activated or fully deactivated.

5. The engine of claim 4 wherein the de-stroking mechanism is a clutch which, when engaged, couples rotation of the crankshaft to rotation of a secondary crankshaft, where the secondary crankshaft is coupled to the expander pistons.

6. The engine of claim 1 wherein the controller deactivates the expander pistons under low-load engine conditions.

7. The engine of claim 6 wherein the controller establishes the desired stroke of the expander piston as zero when an exhaust system temperature is below a temperature threshold value or an engine torque is below a torque threshold value, and the controller establishes the desired stroke of the expander piston as full stroke when the exhaust system temperature is above the temperature threshold value and the engine torque is above the torque threshold value.

8. The engine of claim 6 wherein the controller includes a hysteresis effect when deactivating or reactivating the expander piston.

9. The engine of claim 1 wherein the two or more groups of three pistons includes six pistons in a straight-six configuration, where the four power pistons have a common orientation and operate along centerlines which are coplanar, and the two expander pistons have a common orientation and operate along centerlines which are coplanar.

10. The engine of claim 1 wherein the two or more groups of three pistons includes six pistons in a V-six or a horizontally opposed configuration, with two power pistons and one expander piston in a first cylinder bank and two power pistons and one expander piston in a second cylinder bank.

11. The engine of claim 1 wherein the engine is used to power an automobile.

12. A supercharged piston compound internal combustion engine with expander de-stroking, said engine comprising:

a rotating crankshaft;

two or more groups of three pistons, where each group includes two power pistons coupled to the rotating crankshaft, said power pistons providing engine power for an automobile as a result of a primary expansion of combustion gases from ignition of a fuel-air mixture, and a secondary expander piston, said expander piston providing additional engine power as a result of a secondary expansion of the combustion gases after the primary expansion by the power pistons;

a de-stroking mechanism which couples motion of the expander pistons to motion of the power pistons and which provides for reducing or eliminating a stroke of the expander pistons under certain engine conditions, where the de-stroking mechanism is a variable stroke mechanism comprising a stroke adjustment link which adjustably couples the stroke of the expander pistons to a stroke of the power pistons; and a controller configured to measure engine conditions, establish a desired stroke of the expander pistons based on the engine conditions, and communicate the desired stroke to the de-stroking mechanism.

13. The engine of claim 12 wherein the variable stroke mechanism allows the stroke of the expander pistons to be continuously adjustable from a minimum stroke value to a full stroke value.

14. The engine of claim 12 wherein the controller uses exhaust system temperature and engine load data to establish the desired stroke of the expander pistons, where the desired stroke of the expander pistons is reduced for lower values of exhaust system temperature and engine load, and the controller further includes a hysteresis effect when deactivating or reactivating the expander pistons.

15. The engine of claim 12 wherein the two or more groups of three pistons includes six pistons in a straight-six configuration, where the four power pistons have a common orientation and operate along centerlines which are coplanar, and the two expander pistons have a common orientation and operate along centerlines which are coplanar.

16. The engine of claim 12 wherein the two or more groups of three pistons includes six pistons in a V-six or a horizontally opposed configuration, with two power pistons and one expander piston in a first cylinder bank and two power pistons and one expander piston in a second cylinder bank.

17. A method for controlling a piston compound internal combustion engine with expander piston de-stroking, said method comprising:

measuring an exhaust system temperature;

determining an engine load;

establishing a desired stroke of the expander piston based on the exhaust system temperature and the engine load, including setting the desired stroke equal to a minimum value when the exhaust system temperature is below a temperature threshold and, if the exhaust system temperature is at or above the temperature threshold, using the engine load to determine the desired stroke; and controlling a de-stroking mechanism in the engine to achieve the desired stroke of the expander piston.

18. The method of claim 17 wherein the de-stroking mechanism is a variable stroke mechanism comprising a stroke adjustment link which adjustably couples a stroke of the expander piston to a stroke of power pistons in the engine.

19. The method of claim 18 wherein using the engine load to determine the desired stroke includes setting the desired stroke equal to a minimum value when the engine load is less than or equal to a first load threshold, setting the desired stroke equal to full-stroke when the engine load is greater than or equal to a second load threshold, and using a ramp function to determine the desired stroke when the engine load is between the first load threshold and the second load threshold.

20. The method of claim 17 wherein the de-stroking mechanism is a clutch which, when engaged, couples rotation of an engine crankshaft to rotation of a secondary crankshaft which is coupled to the expander piston, and where using the engine load to determine the desired stroke includes setting the desired stroke equal to zero when the engine load is less than or equal to a load threshold and setting the desired stroke equal to full-stroke when the engine load is greater than a load threshold.

* * * * *